US005265529A

United States Patent [19]

Tafel

[11] Patent Number: 5,265,529

[45] Date of Patent: Nov. 30, 1993

[54] SINGLE PISTON IMPRESSION CYLINDER THROW-OFF

[75] Inventor: Leonard I. Tafel, Mount Prospect, Ill.

[73] Assignee: A. B. Dick Company, Niles, Ill.

[21] Appl. No.: 895,626

[22] Filed: Jun. 9, 1992

[51] Int. Cl.[5] ..... B41F 7/02

[52] U.S. Cl. ..... 101/218; 101/247

[58] Field of Search ..... 101/218, 247, 137

[56] References Cited

U.S. PATENT DOCUMENTS

| | | | |
|---|---|---|---|
| 2,874,636 | 2/1959 | Royer et al. | 101/218 |
| 3,046,881 | 7/1962 | Jurny | 101/218 |
| 4,281,595 | 8/1981 | Fujishiro | 101/218 X |
| 4,369,705 | 1/1983 | Gelinas | 101/218 X |
| 4,442,773 | 4/1984 | Kobayashi | 101/218 X |
| 4,875,936 | 10/1989 | Hermach | 101/218 |
| 5,094,162 | 3/1992 | Tafel et al. | 101/137 |

*Primary Examiner*—Eugene H. Eickholt

*Attorney, Agent, or Firm*—Jones, Day, Reavis & Pogue

[57] ABSTRACT

An offset printing machine that has an eccentrically mounted blanket cylinder operated by a single piston that moves the blanket cylinder from a first position separating the blanket cylinder from both the master cylinder and the impression cylinder to a second position engaging the blanket cylinder with the master cylinder for inking and to a third position engaging both the master cylinder and the impression cylinder for printing.

13 Claims, 4 Drawing Sheets

SINGLE PISTON IMPRESSION CYLINDER THROW-OFF

FIELD OF THE INVENTION

The present invention relates in general to offset printing machines and in particular to an offset printing machine that has an eccentrically mounted blanket cylinder operated by a single piston that moves the blanket cylinder into and out of sequential engagement with the plate or master cylinder and the impression cylinder.

BACKGROUND OF THE INVENTION

Offset printing machines are well known in the art and include a master or plate cylinder having a plate for carrying a transferable image thereon and an impression cylinder for carrying paper to receive the image. A blanket cylinder is interposed between the master cylinder and the impression cylinder such that the blanket cylinder moves eccentrically about a first pivot point to make pressure contact with the master cylinder for receiving the image and subsequently moves eccentrically about a second pivot point for making pressure contact with the impression cylinder to transfer the image to the paper. Such system is disclosed in U.S. Pat. No. 4,691,631.

Two-color offset printing machines are also known and they include a single impression cylinder, two master cylinders and two blanket cylinders. A first blanket cylinder is caused to move eccentrically about a first axis to make contact with a first master cylinder and receive the image therefrom and then move eccentrically about a second pivot point to make contact with the impression cylinder and transfer the first color to the paper on the impression cylinder. The impression cylinder then rotates and carries the image on the paper to the other pair of master and blanket cylinders where the second blanket cylinder moves eccentrically into contact with the second master cylinder to receive the second color and subsequently moves eccentrically into contact with the impression cylinder to transfer the second color to the paper. This system is also disclosed in U.S. Pat. No. 4,691,631.

In both the single and double color offset printing machines, a predetermined contact pressure must be maintained between the blanket cylinder and the master cylinder and between the blanket cylinder and the impression cylinder. Thus, the mounts for eccentrically supporting the blanket cylinder are rotationally forced against a fixed but adjustable stop which is manually adjusted in the prior art to allow a desired amount of pressure at the contact points between the master and the blanket cylinders and between the blanket and impression cylinders, respectively. Adjustment is time-consuming, but readjustment is required for wear and the like as the press is generally set up to print with a relatively fixed thickness of plates, blankets and paper stock. Adjustment, if it is required, is accomplished by varying the thickness of the packing sheets underneath the plate on the master cylinder or underneath the blanket on the blanket cylinder or by varying the center distance of the cylinders.

Small sheet-fed presses, in particular, are required to accommodate a wide range of plate and paper stock thicknesses and thus such semipermanent adjustments mentioned previously are unusable. If the settings are to be made frequently, then they must be done simply and quickly which is difficult as the adjustment of the actuating means requires that the stops on each end of the cylinders must also be accurately readjusted. Because it is necessary for the eccentrics to rotate freely, thereby necessitating some clearance or springiness as in the case of bearings, if rigid stops, such as used in adjusting a web-type press, are not used to rotationally position the eccentrics, there will be a looseness which will allow the printing cylinders to bounce slightly which will be visible in the printing.

Further, the use of one piston to cause the impression/blanket throw-off and another cylinder to cause the plate/blanket throw-off requires a great number of parts that must all work independently but closely together to provide the desired results. Thus, there is first an "off/off" position where the blanket cylinder contacts neither the plate cylinder nor the impression cylinder. Then there is the "off/on" condition where this is contact between the blanket cylinder and the plate cylinder but not between the blanket cylinder and the impression cylinder. Finally there is the "on/off" condition where there is contact between the blanket cylinder and the impression cylinder but not between the blanket cylinder and the plate cylinder.

The present invention discloses a simplified version of an offset printing apparatus in which there is no need for a separate blanket throw-off, the "on/off" condition where there is contact between the blanket cylinder and impression cylinder but not between the blanket cylinder and the plate cylinder. The present invention uses a single eccentric shaft, including an adjustable eccentric tube rotated by a single piston that causes the blanket cylinder rotatably mounted on the eccentric shaft to move first from an "off/off" position to an "off/on" position where the blanket cylinder is in contact with the plate cylinder only and then to an "on/on" position where the blanket cylinder contacts both the plate cylinder and the impression cylinder. This apparatus has the advantage of providing an "inking" position wherein the blanket and plate cylinders make normal contact but there is a minimum gap of 0.010-inch over the thickest paper on the impression cylinder. This is accomplished by associating a solenoid latch with the air cylinder lever to stop it in an intermediate location called the "inking" position. With the inking forms removed from the plate or master cylinder, "printing off" of ink on the blanket cylinder can be accomplished in the "on/on" position.

A double offset printing machine can be constructed with the present invention thus utilizing only one piston for each set of cylinders to cause the blanket cylinder to contact first the plate cylinder and then both the plate and impression cylinders. This present design has only one-third as many parts as the existing mechanisms.

Thus, it is an object of the present invention to provide an offset printing machine that utilizes only one piston to cause the blanket cylinder axis to move along an arc from a first position that separates the blanket cylinder from both the master cylinder and the impression cylinder to a second position that engages the blanket cylinder with the master cylinder for inking and on to a third position that engages the blanket cylinder with both the master cylinder and the impression cylinder for transferring the image on the master cylinder to the paper on the impression cylinder. An eccentric mechanism is used to adjust the eccentric shaft such that the distance from the blanket to the impression cylinder can be adjusted from a minimum to a maximum to compensate for change in blanket thickness, wear or paper thickness.

It is also an object of the present invention to mount the blanket cylinder on an eccentric tube for rotation about the eccentric tube with the eccentric tube adjustably mounted on the eccentric shaft so that by moving the eccentric tube with respect to the shaft, the blanket cylinder/master cylinder distance can also be adjusted for wear and blanket thickness.

It is still another object of the present invention to provide a latch for holding the eccentric shaft in one position with respect to the master cylinder for inking of the blanket cylinder.

It is yet another object of the present invention to provide a two-color offset printer having a single impression cylinder and two master cylinders and two blanket cylinders where each blanket cylinder is operated by a single piston.

SUMMARY OF THE INVENTION

Thus, the present invention relates to an offset printing machine comprising laterally spaced vertical frame side walls, a fixed master cylinder rotatably mounted between the walls for carrying a transferable image thereon, a fixed impression cylinder rotatably mounted between the walls for carrying paper thereon to receive the image, an eccentric shaft rotatably mounted between the walls for movement about an axis, a blanket cylinder rotatably associated with the eccentric shaft for rotation about an axis spaced from and parallel to the axis of the eccentric shaft, and a device for rotating the eccentric shaft to first, second and third positions to cause the blanket cylinder axis to move along an arc from a corresponding first position that separates the blanket cylinder from both the master cylinder and the impression cylinder to a second position that engages the blanket cylinder with the master cylinder for inking and to a third position that engages the blanket cylinder with the both the master cylinder and the impression cylinder for transferring the image on the master cylinder to the paper on the impression cylinder.

BRIEF DESCRIPTION OF THE DRAWINGS

These and other objects and advantages of the present invention will be more fully disclosed in the following detailed description of the drawings in which like numerals represent like elements and in which.

DETAILED DESCRIPTION OF THE DRAWINGS

Figures 1, 2:
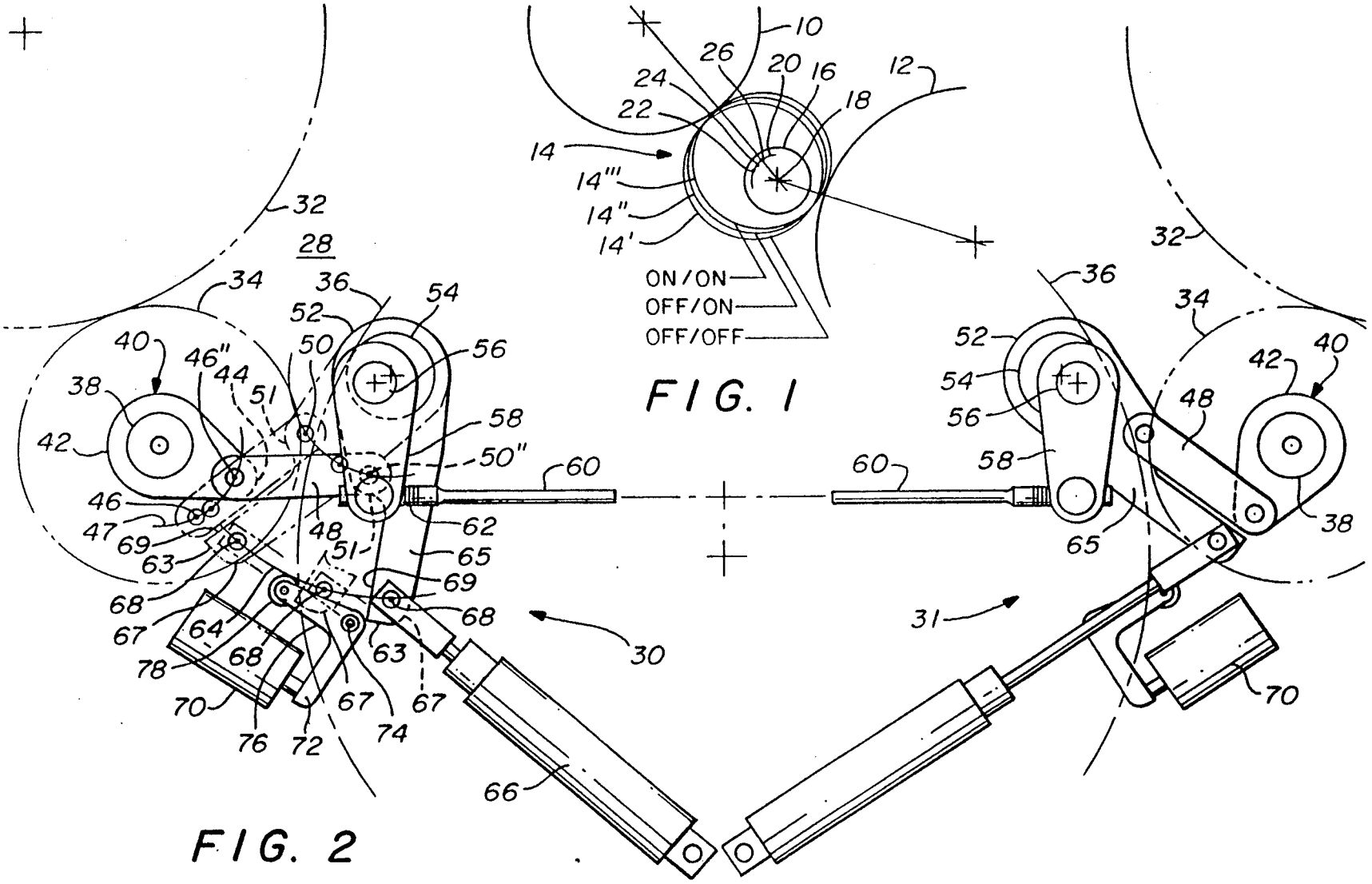
FIG. 1 is a schematic representation of the movement of the blanket cylinder from a first position, in which it contacts neither the master cylinder nor the impression cylinder, to a second position, where it contacts only the master cylinder image for inking, and to a third position, where it contacts both the master cylinder and the impression cylinder for transferring the image to the impression cylinder.
FIG. 2 is a schematic representation of a dual offset printing apparatus that utilizes the present invention wherein one piston moves a respective blanket cylinder into contact with both the master cylinder and the impression cylinder, away from contact with the impression cylinder and into the contact with only the master cylinder for inking and out of engagement with either the master cylinder or the impression cylinder.

As set forth in commonly assigned U.S. Pat. No. 5,094,162, issued Mar. 10, 1992, entitled "Offset Printing Machine", which is incorporated herein by reference in its entirety, offset printing machines are well known in the art. In those systems, paper sheets from a paper stack are picked in any well-known manner such as by sucker tubes and are conveyed to a paper feed conveyer and a transfer cylinder. The paper stops and registers and then the transfer cylinder grips the paper and transfers it to the impression cylinder that also has grippers thereon to pick up the sheets. A system for transferring ink to apply the image to the sheet includes an offset blanket cylinder and a master cylinder. At the beginning of the operation of the machine, the system requires that the image transmitting services on the blanket cylinder be suitably inked in order to print an acceptable image on the initial sheet of paper on the impression cylinder as the sheet of paper passes through the machine. Accordingly, before the blanket cylinder contacts the sheet of paper on the impression cylinder it is desirable that it be inked. Thus, the surface of the blanket cylinder is brought into contact with the surface of the master cylinder. Once the surface of the blanket cylinder is inked, it is brought into contact successively with the sheet of paper on the impression cylinder. The sheet of paper then passes through a delivery cylinder to the receiving stack. In such systems, a piston first moves the blanket cylinder into contact with the master cylinder to be inked and then a second piston moves the blanket cylinder into contact with the impression cylinder for transferring the image to the paper on the impression cylinder.

The present invention utilizes only one piston to move the blanket cylinder from a first position where it has no contact with the other cylinders to a second position where it contacts the master cylinder for inking and to a third position where it contacts both the master cylinder and the impression cylinder to transfer the image to the paper. The system is shown generally in FIG. 1 simply as a schematic representation and illustrates master cylinder 10, impression cylinder 12 and blanket cylinder 14. The blanket cylinder 14 is mounted on an eccentric shaft 16. As the eccentric shaft is rotated clockwise and counterclockwise about its center 18, the axis of the blanket cylinder 14 moves along an arc 20 to first, second and third positions 22, 24 and 26, respectively. It is to be understood that as the axis of the blanket cylinder 14 moves along arc 20, it moves only a few thousandths of an inch and, thus, the illustration in FIG.

1 is exaggerated to illustrate the principle of the device. Thus, when eccentric shaft 16 is positioned such that the axis of blanket cylinder 14 is at point 22, the blanket cylinder 14' is in contact with neither the master cylinder 10 nor the impression cylinder 12. This is designated the OFF/OFF position. As the eccentric shaft 16 is rotated clockwise such that the axis of blanket cylinder 14 moves to point 24, the blanket cylinder 14'' comes in inking contact with the master cylinder 10, but is still separated from the impression cylinder 12. As will be disclosed hereafter, the blanket cylinder 14 can be latched in this position, known as the OFF/ON position to allow several revolutions of the blanket cylinder 14'' to be properly inked. As the eccentric shaft 16 is rotated further clockwise such that the axis of the blanket cylinder 14''' moves to point 26, it comes in contact with both the master cylinder 10 and the impression cylinder 12 for transferring the image to the impression cylinder. To move the eccentric shaft 16 in the reverse direction simply reverses the process. A single piston is used to rotate the eccentric shaft 16 to provide for the movement of the blanket cylinder 14 to the three positions 14', 14'' and 14''' as illustrated in FIG. 1. Further adjustments are provided which enable the movement of the blanket cylinder 14 towards the master cylinder 10 as well as movement of the blanket cylinder 14 towards the impression cylinder 12 to accommodate for blanket thickness, wear and paper thickness.

FIG. 2 illustrates, in a schematic drawing, the integrated plate and impression cylinder throw-off mechanisms for a dual offset printing machine. The apparatus 28 includes a first throw-off mechanism 30 and a second throw-off mechanism 31. Because the two mechanisms 30 and 31 work in an identical manner, only mechanism 30 will be discussed in detail. In FIG. 2, the plate or master cylinder 32 is illustrated along with the blanket cylinder 34 and the impression cylinder 36. Blanket cylinder 34 is mounted on eccentric shaft 38 which is rotated by a tear-drop shaped plate 40 having the large end 42 attached to the eccentric shaft 38 and the small end 44 pivotally coupled to a link 48 at pivot point 46. The other end of link 48 is pivotally attached at pivot point 50 to a shoulder or projection 51 on a lever 52. Lever 52 is pivotally mounted on a plate or that is mounted on shaft 56 in the frame side walls 92 and 94 in an eccentric manner such that rotation of shaft 56 also eccentrically rotates disc 54 and positions lever 52 as will be discussed hereafter. An adjustment arm 58 is attached to shaft 56 and an adjustment rod 60 is threadedly coupled to the outer end of adjustment arm 58 to adjust the rotation of eccentric shaft 56 and thereby adjust the movement of the blanket cylinder 34 with respect to the impression cylinder 36. A single air cylinder 66 is coupled at the end 68 thereof to the outer end 63 of an arm 65 that extends beyond the projection 51 such that the arm 65 is adjacent and parallel to the link 48 when the lever 52 is in its locked position (shown in FIG. 4). As air cylinder 66 moves pivot point 68 along arc 64, the arm 65 causes shoulder 51 of lever 52 to move link 48 as will be shown hereafter which, in turn, is connected to and moves the end 44 of the plate 40 at pivot point 46 along arc 47. Plate 40 is attached to the eccentric shaft 38 thus moving the blanket cylinder 34 into and out of engagement with the master and impression cylinders 32 and 36 as will be discussed hereafter. A solenoid 70 is operatively associated with a latch 72 such that actuation of the solenoid 70 moves latch 72 about pivot point 74 thus causing roller 78 on the outer end 76 of the latch 72 to move out of the path of the outer end 63 of arm 65. When the solenoid 70 is de-energized, the roller 78 is held in the path as indicated in FIG. 2 by any well-known means such as a spring (not shown), thus allowing the arm 65 to move counterclockwise because the curved edge 67 of the lower end 63 of arm 65 contacts the roller 78 and pivots the latch 72 downwardly and rolls past it. However, when the cylinder 66 is moving the arm 65 in a clockwise direction, the arm 65 has a flat edge 69 on the lower end 63 as shown that contacts the roller 78 and prevents further clockwise movement of arm 65. This is known as the inking position and allows the blanket cylinder to contact the master cylinder over several revolutions as desired to be inked. When the solenoid 70 is energized, the latch 72 pivots the roller 78 out of the path of the flat edge 69 on the lower end 63 of arm 65 thus allowing the air cylinder 66 to move arm 65 to the locked position where the blanket cylinder 34 engages the master cylinder 32 and the impression cylinder 36.

As will be shown in more detail hereafter, when the adjustment arm 58 is moved by adjustment rod 60, shaft 56 moves eccentric disc 54 to cause plate 40 to pivot the blanket cylinder eccentric shaft 38 thus changing the blanket cylinder/impression cylinder separation.

Figure 3:
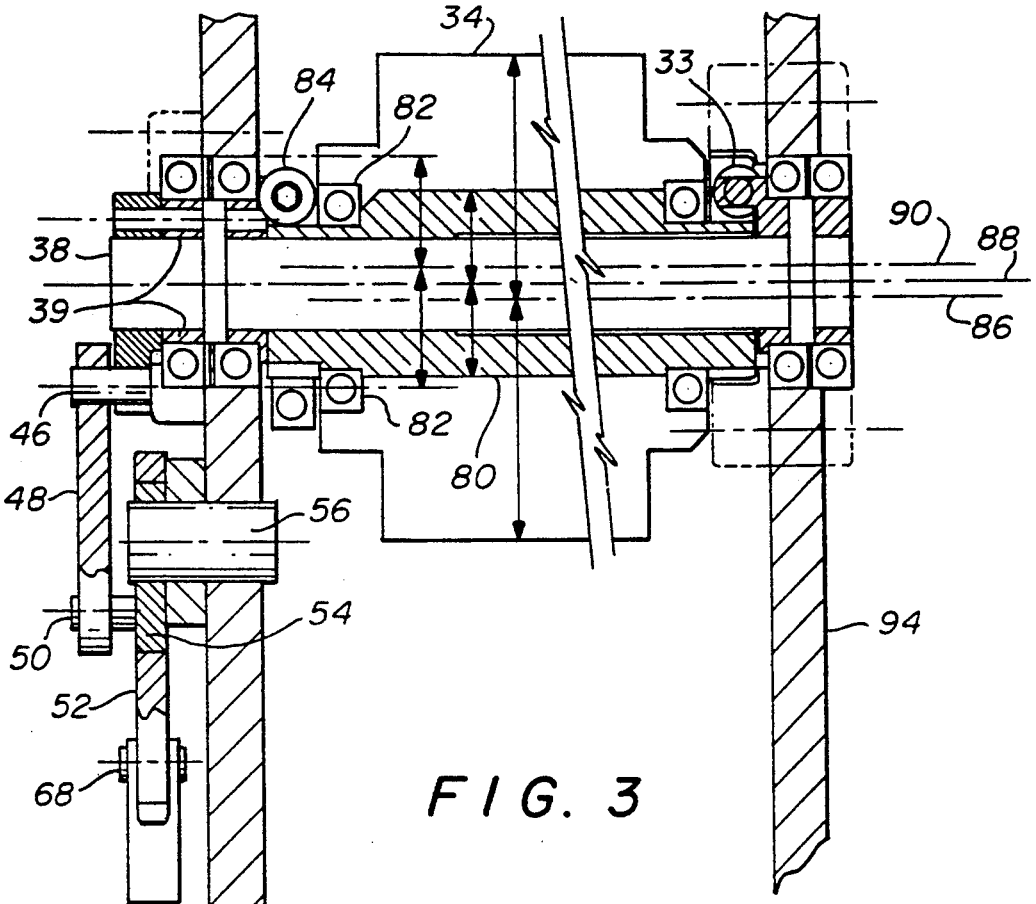
FIG. 3 is a partial cross-sectional representation of one of the single-piston throw off mechanisms illustrated in FIG. 2.

A partial cross-sectional view of the apparatus is illustrated in FIG. 3. As can be seen in FIG. 3, the blanket cylinder 34 is mounted on bearings 82 on an eccentric tube 80 and rotates about center line 86. The tube 80 is eccentrically mounted on shaft 38 that is eccentrically mounted in side walls 92 and 94. Tube 80 pivots about axis 88 and shaft 38, although its center line is 88, pivots about axis 90 because it is mounted in an eccentric element 39 in walls 92 and 94. A plate thickness adjusting screw 84 is calibrated and mounted on the eccentric tube 80 and works against a protrusion (not shown) from the shaft eccentric 38. This adjusts the relative position of the tube 80 with respect to shaft 38 thus adjusting the separation between the master cylinder 32 and the blanket cylinder 34 as will be shown hereafter. A Belleville spring stock 33, well-known in the art, may be added to the drive side opposing the action of the lever 52 to remove any play in the system.

Figure 4:
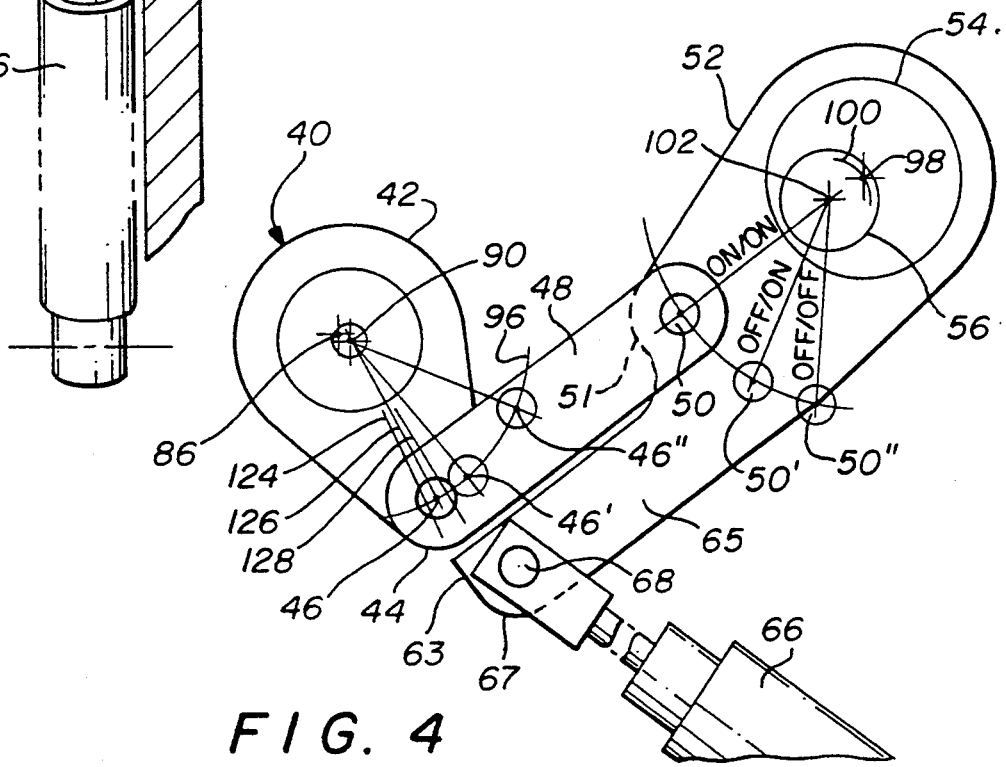
FIG. 4 is an enlarged view of the novel throw off mechanism illustrating the movement of the eccentric lever to cause the eccentric shaft to move the blanket cylinder into the off/off, off/on and on/on positions.

FIG. 4 is a diagrammatic representation of the throw-off mechanism and the manner in which the blanket cylinder/impression cylinder separation can be adjusted.

As can be seen in FIG. 4, when adjustment arm 58 (in FIG. 2) pivots shaft 56 about its axis 102, the eccentrically mounted disc 54 has its center 98 move along arc 100. As center 98 moves along arc 100, it causes the link 48 to move closer to or further away from the center line 126 that passes through pivot point 46 and the frame bore center 90. Line 126 represents the mean separation of the blanket cylinder 34 and the impression cylinder 36. When the blanket cylinder 34 is new and all the parts are new, there is a maximum diameter of the blanket cylinder and it is at its closest point to the impression cylinder 36. Thus the adjustment must be made to move the pivot point 46 of plate 40 along arc 96 until it lies along line 128. As the parts continue to wear, and the blanket thickness decreases, the eccentric 56 is rotated to cause link 48 to move the pivot point 46 along arc 96 to the intersection of line 124 which represents the minimum thickness of the blanket cylinder 34 and moves the blanket cylinder 34 closer to the impression cylinder 36. Thus by rotating eccentric disc 54 mounted on adjustable shaft 56, the blanket/impression cylinder adjustment can be made. In the position illustrated in FIG. 4, the arm 65 that extends beyond the shoulder 51 of lever 52 is parallel to link 48 and the pivot points of each end of the link 46 and 50 are in alignment with each other and the center 102 of shaft 56, but not the center 98 of shaft 54. This relationship is more clearly illustrated in FIG. 7. This is the locking position and the position in which the blanket cylinder 34 is in contact with both the master cylinder 32 and the impression cylinder 36. As the air cylinder moves arm 65 to the position shown in FIG. 4 where pivot point 50 becomes pivot point 50', the blanket cylinder 34 is moved out of contact with the impression cylinder 36 but is still in contact with the master or plate cylinder 32. As the arm 65 is moved further to bring the pivot point 50 to the point designated 50", the blanket cylinder 34 is in contact with neither the master cylinder 32 or the impression cylinder 36 and this position is called the OFF/OFF position.

The center line 86 of the eccentric tube can be seen in FIG. 4 to be offset from the frame bore center 90. Thus it will be understood that as the tear-drop shaped plate 44 is pivoted about bore axis 90, the axis 86 of the blanket cylinder will move in an arc. The details of the movement of pivot point 86 of the blanket cylinder along that arc is illustrated in FIG. 5.

Figure 5:
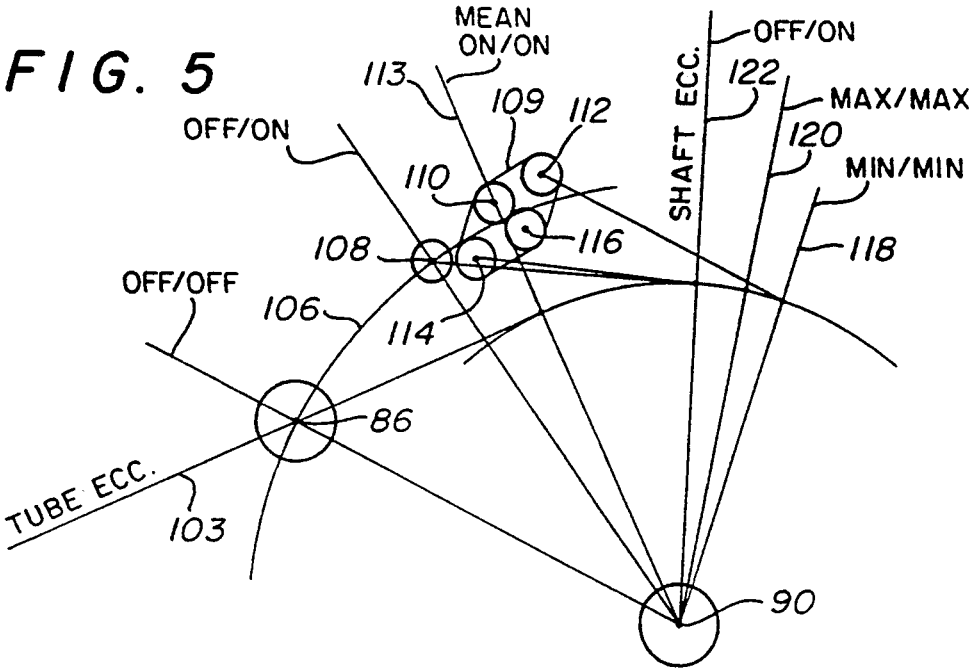
FIG. 5 is an enlarged representation of the movement of the axis of the blanket cylinder along an arc to illustrate the various positions thereof.

As can be seen FIG. 5, as shaft 38 is pivoted or rotated about pivot point 90, the center 86 of the blanket cylinder 34 moves along arc 106. When located at position 86 shown in FIG. 5, the blanket cylinder 34 engages neither the master cylinder 32 nor the impression cylinder 36. This is the OFF/OFF position. When the shaft 38 is rotated about the point 90 such that pivot point 86 moves to area 108, the movement along arc 106 brings the blanket cylinder 34 into engagement with plate cylinder 32. As the shaft 38 is rotated further about point 90, the center line 86 of blanket cylinder 34 moves into the diamond-shaped area 109 which is the area of adjustment of the blanket cylinder 34 with the impression cylinder 36 and the adjustment of the blanket cylinder 34 to the master cylinder 32 as will be discussed hereafter. Thus the blanket cylinder axis 86 can be moved between areas 110 and 114 to areas 112 and 116 to adjust the separation of the master cylinder 32 and the blanket cylinder 34 without affecting the adjustment of the blanket cylinder 34 in relation to the impression cylinder 36. In like manner, the adjustment of the blanket cylinder 34 with respect to the master cylinder 32 can be moved from or between points 110 and 114 to 112 and 116 without affecting the separation of the blanket cylinder 34 from the impression cylinder 36. Thus, the center line 86 of the blanket cylinder 34 can be adjusted to fall between points 114 and 116 or 110 and 112 to affect an adjustment of the separation of the blanket cylinder 34 with the impression cylinder 36 without affecting the adjustment between the master cylinder 32 and the blanket cylinder 34. This will be shown more clearly in relation to FIG. 6. When the axis 86 of the blanket cylinder 34 moves along arc 106 until it intersects the MEAN ON/ON line 113, the blanket cylinder 34 will be in contact with BOTH the master cylinder 32 and the impression cylinder 36 with the blanket cylinder 34 having a MEAN diameter. It is to be understood that when the blanket on the blanket cylinder 34 is new, the cylinder will have a MAXIMUM diameter. As it is used, it will reduce to a MEAN diameter and then to a MINIMUM diameter. This will be discussed in more detail in relation to FIG. 6. Adjustment of eccentrically mounted disc 54 by adjustment arm 58 moves the tear-drop shaped plate 44 to the lines 124, 126 and 128 which represent the MINIMUM, MEAN and MAXIMUM blanket thicknesses, respectively, as illustrated in FIG. 4. Thus in FIG. 5, when the shaft 38 eccentricity is adjusted between the OFF/ON position 122, the MAX/MAX position 120 and the MIN/MIN position 118, the blanket cylinder axis 86 moves in the diamond area 109 where it can be adjusted for maximum blanket thickness for both the master cylinder 32 and the impression cylinder 36 or for a minimum blanket thickness for both the master cylinder 32 and the impression cylinder 36. By adjusting the plate thickness adjusting screw 84 shown in FIG. 3, the tube eccentric line 103 will move along perpendicular line 113 thus moving axis 86 of blanket cylinder 34 on a line parallel to line 113 along arc 106 which is the MEAN position line illustrated in FIG. 5.

Figure 6:
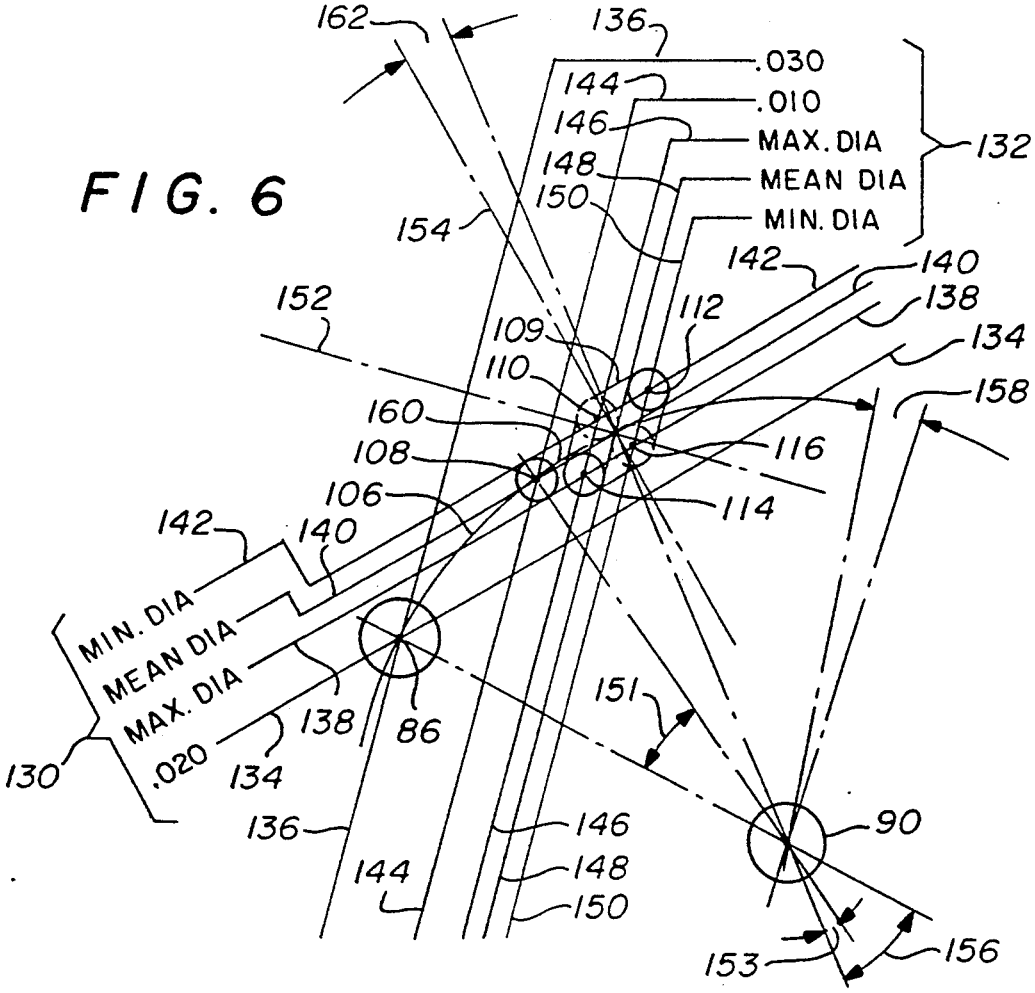
FIG. 6 is a diagrammatic representation of the geometry of the master cylinder, blanket cylinder and the impression cylinder as the blanket cylinder axis moves in an arc by rotation of the eccentric shaft.

FIG. 6 more clearly illustrates this relationship. The center 90 represents the axis of the frame bore in which eccentric shaft 38 is mounted. Arc 106 represents the movement of the center axis 86 of blanket cylinder 34 when the eccentric shaft 38 is moved about pivot point 90. As the center axis 86 moves across lines 134, 138, 140 and 142, the blanket cylinder 34 moves closer or further away from the master cylinder 32. As the axis 86 crosses lines 144, 146, 148 and 150, the blanket cylinder 34 moves closer or further away from the impression cylinder 36. Thus when the axis 86 is positioned as shown, it is on the intersection of lines 136 and 134. Line 134 indicates that with the center axis 86 of blanket cylinder 34 at that point, a separation of 0.020 inch between the blanket cylinder 34 and the master cylinder 32 exists. Line 136 indicates that when the point 86 is as shown, a separation of 0.030 of an inch exists between the blanket cylinder 34 and the impression cylinder 36. If the blanket on the blanket cylinder 34 has sufficient wear to have a MEAN diameter, when point 86 has moved along arc 106 to point 108, the blanket cylinder 34 is in contact with the master cylinder 32 for inking but now also lies on line 144 which indicates that it has a 0.010 inch clearance with respect to the impfession cylinder 36. When point 86 moves further to the intersection of lines 140 and 148, the blanket cylinder 34 is contacting both the master cylinder 32 and the impression cylinder 36. Note that the cordal height between the arc 106 and the chord connecting the intersection of lines 140 and 144 and 140 and 148 is only 0.0005 inch.

Notice that if the blanket cylinder 34 has been worn to a minimum diameter, area 112 intersects lines 142 and 150; thus the adjustment can be made to compensation for a minimum diameter blanket cylinder 34. In like manner, area 114 intersects lines 138 and 146 which represent a maximum diameter blanket cylinder 34; thus the blanket cylinder 34 can be adjusted such that the arc 106 will pass through the center line of area 114 if the blanket cylinder 34 has a maximum thickness. At that point, blanket cylinder 34 will contact both the master cylinder 32 and the impression cylinder 36. It will be seen, then, that adjustment of the blanket cylinder 34/impression cylinder 36 separation moves the blanket cylinder axis 86 between areas 114 and 116 or between 110 and 112. Adjustment of the blanket cylinder 34/master cylinder 32 separation moves the axis 86 between areas 114 and 110 and between 116 and 112.

Thus rotation of eccentric shaft 38 about pivot point 90 moves the axis 86 of blanket cylinder 34 from a first OFF/OFF position that separates the blanket cylinder 34 from both the master cylinder 32 and the impression cylinder 36 to a second position 108 in FIG. 6 where it contacts the plate cylinder for inking and requires a movement of 27.5809° as shown by angle 15. Further clockwise movement of the eccentric shaft 38 about pivot point 90 another 12.1294° as shown by angle 153 moves the blanket cylinder 34 to a third position into contact with both the master cylinder and the impression cylinder 36 for printing. The master cylinder to blanket cylinder adjustment range as shown by angle 158 is 6.4921°. This is the amount the adjustment screw 84 shown in FIG. 3 can move the eccentricity of the tube 80 to make the adjustment shown in FIG. 6. Angle 162 is 6.1508° and is the angle of separation between the center line of the master cylinder 34 perpendicular to a tangent in its outer edge and the center line passing through axis 90 of eccentric shaft 38 at its point of ON/ON condition where it is both inking and printing. Thus the total throw-off motion from OFF/OFF position to the ON/ON position is 39.7103°.

Figure 7:
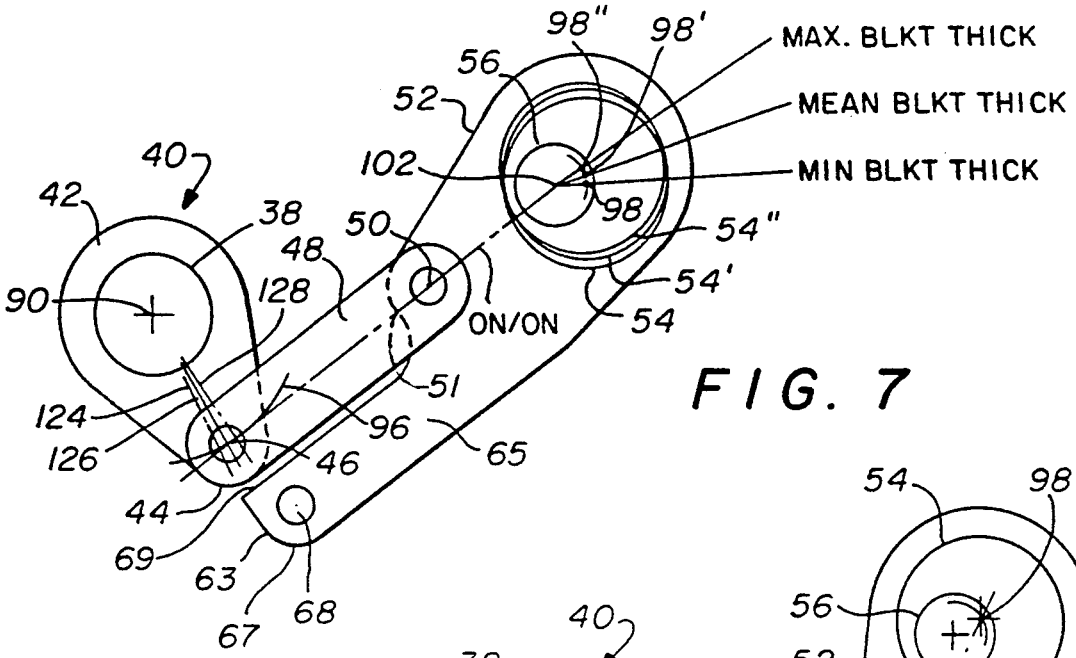
FIG. 7 is an illustration of the novel linkage shown in the "on/on" impression position.

FIG. 7 is an enlarged view of the linkage shown in the MEAN "ON/ON" impression position. It can be seen in FIG. 7, in the ON/ON position, that shaft 56 can be rotated about its axis 102 to move the center axis of eccentric adjustment disc 54 from position 98 for minimum blanket thickness to position 98' for mean blanket thickness and to position 98" for maximum blanket thickness. At each of those positions the disc 54 moves to a corresponding position 54' and 54" as shown. This causes linkage 48 to move pivot point 46 of small end 44 of plate 40 along arc 96 to cause the center line joining pivot point 46 and axis 90 to lie along lines 124, 126 or 128. When in position on line 124 it represents the minimum thickness of the blanket cylinder 14; when it is in position on line 126 it is the mean position and when it is on line 128 it is on the maximum position. Thus rotation of the impression adjustment disc 54 by the eccentric shaft 56 moves pivot 46 of the linkage 48 to adjust the distance between the blanket and impression cylinders. This is the lock position. Note that the pivot points 46 and 50 of the linkage 48 and the pivot point 102 of shaft 56 are in alignment, but that the center line 98 (or 98' or 98") of disc 54 lies off to the right of the line connecting pivot points 46, 50 and 102. This causes a locking position since the toggle link 48 locks over or beyond the center 98 of the impression cylinder adjustment disc 54.

Figure 8:
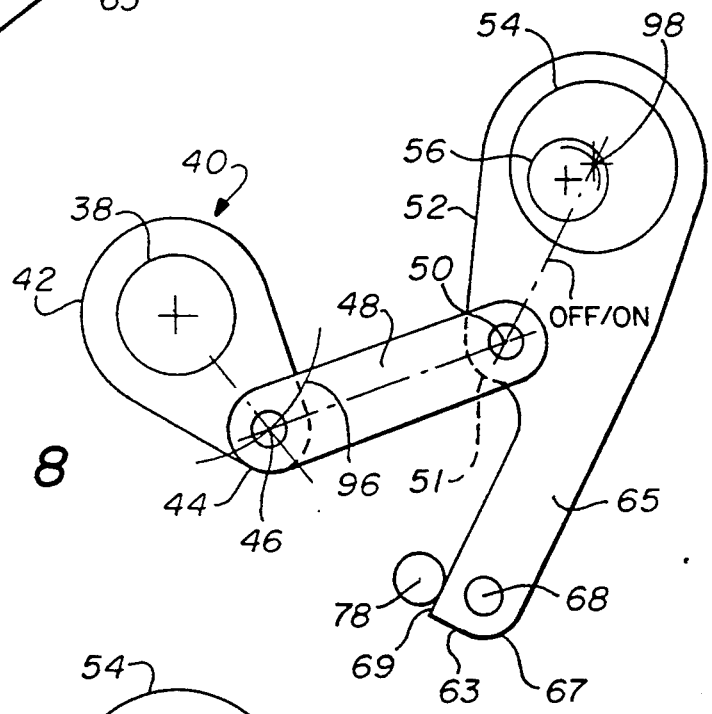
FIG. 8 is a diagram of the linkages shown in the "inking" position.

FIG. 8 illustrates the linkages shown in the "inking" position. In this position there is contact between the blanket cylinder 34 and the plate or master cylinder 32 with clearance between the blanket cylinder 34 and the impression cylinder 36. This is the "OFF/ON" position. Note that solenoid operated latch 78, described previously in relation to FIG. 2, is in front of the straight edge 69 of the lower portion 63 of arm 65 thus preventing arm 65 from moving clockwise towards latch 78. This is the inking position.

Figure 9:
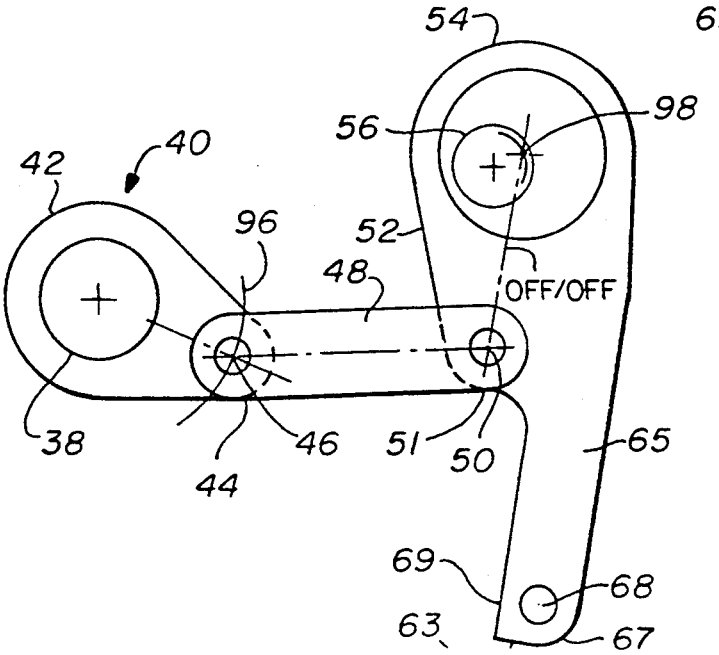
FIG. 9 is a diagram of the linkages shown in the "throw off" position where there is clearance between all cylinders.

FIG. 9 illustrates the linkages in the "throw-off" position. Here there is clearance between all cylinders.

Thus, there has been disclosed a novel offset printing machine in which a single piston moves the blanket cylinder first into contact with the master or plate cylinder for inking and subsequently into engagement with the impression cylinder such that the image transferred from the master cylinder to the blanket cylinder is transferred to the paper on the impression cylinder. The blanket cylinder is eccentrically mounted on a tube that is also eccentrically mounted on a shaft that is eccentrically mounted in the frame walls. A lever arm is coupled through linkages to the eccentric shaft for rotating the eccentric shaft over an arcuate portion to bring the blanket cylinder first into contact with the plate cylinder for inking and subsequently into contact with both the plate cylinder and the impression cylinder for printing. The lever arm is attached to a first disc that is eccentrically mounted on a second shaft. By rotating the second shaft, the first disc is caused to rotate such that its pivoting axis moves in an arc thus allowing the linkage to move the eccentric shaft containing the blanket cylinder to adjust the position of the blanket cylinder with respect to the impression cylinder. An adjustment screw is coupled between the eccentric tube and the eccentric shaft on which the blanket cylinder is mounted such that the eccentric tube can be rotated with respect to the eccentric shaft thereby enabling the blanket cylinder position to be adjusted with respect to the plate cylinder.

By using a second blanket cylinder and master cylinder on the opposite side of the impression cylinder and that operate as described previously, a two-color offset press can be constructed in accordance with the present invention.

While the invention has been shown and described with respect to a particular embodiment thereof, this is for the purpose of illustration rather than limitation; and other variations and modifications of this specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

I claim:

1. An offset printing machine comprising:

laterally spaced frame side walls;

a fixed master cylinder rotatably mounted between the walls for carrying a transferable image thereon;

a fixed impression cylinder rotatably mounted between the walls for carrying paper thereon to receive the image;

an eccentric shaft rotatably mounted between the walls for movement about an axis;

a blanket cylinder rotatably mounted on the eccentric shaft for rotation about an axis spaced form and parallel to the axis of the eccentric shaft, said blanket cylinder having a blanket mounted thereon, said blanket having a predetermined thickness;

a plate rigidly coupled to the eccentric shaft;

a level pivotally attached at one end to a frame side wall for pivotal movement to first, second and third positions about an axis at said one end thereof;

a link coupling the lever to the plate such that pivotal movement of the lever about its axis to the first, second and third positions correspondingly rotates the eccentric shaft to first, second and third positions to cause the blanket cylinder axis to move along an arc form a corresponding first position that separates the blanket cylinder from both the master cylinder and the impression cylinder to a corresponding second position that engages the blanket cylinder with the master cylinder for transferring said transferable image form said master cylinder to said blanket cylinder and to a corresponding third position that engages the blanket cylinder with both the master cylinder and the impression cylinder for transferring the image on the blanket cylinder to the paper on the impression cylinder; and an operator adjustable eccentric element mounted in the frame wall for receiving said one end of the lever such that, by rotating the eccentric element predetermined distances, the coupling link is moved to cause the blanket cylinder eccentric shaft to be rotated distances sufficient to adjust the blanket cylinder/impression cylinder relative movement for variation in blanket thickness.

2. An offset printing machine as in claim 1 wherein the plate coupled to the eccentric shaft is tear-drop shaped with the large end attached to the eccentric shaft and the small end pivotally coupled to one end of the link.

3. An offset printing machine as in claim 2 further comprising:

a projection extending from one side of the lever;

the other end of the link being pivotally coupled to the projection on the lever; and the pivot center of each end of the link and the pivot center of the lever being aligned so as to form a locking position when the lever is in its third position causing contact of the blanket cylinder with both the master cylinder and the impression cylinder.

4. An offset printing machine as in claim 3 further including:

the lever having an arm extending beyond the projection such that the arm is adjacent and parallel to the link when the lever is in its locking position;

an orifice in the outer end of the lever arm; and an air cylinder coupled to the orifice in the outer end of the lever arm for pivoting the lever to each one of its three positions.

5. An offset printing machine as in claim 4 further comprising:

an adjustment arm attached at one end to the eccentric element; and adjustment means coupled to the other end of the adjustment arm for pivoting the eccentric element such that the lever moves the link which pivots the plate so as to position the blanket cylinder with respect to the impression cylinder to compensate for blanket thickness variation due to wear.

6. An offset printing machine as in claim 5 wherein the adjustment means is a rotatable rod attached to the frame and having threads on one end thereof engaging corresponding threads on the adjustment arm such that as the threaded rod is rotated, the adjustment arm is pivoted.

7. An offset printing machine as in claim 6 further comprising:

an eccentric tube mounted on the eccentric shaft for arcuate movement about the eccentric shaft and having the blanket cylinder rotatably mounted thereon;

bearings mounted between the eccentric tube and the blanket cylinder to allow the blanket cylinder to rotate;

mounting means attached to the frame for supporting the eccentric shaft and enabling adjustable arcuate movement of the eccentric tube about the eccentric shaft; and an adjusting screw mounted on said eccentric tube for accurately adjusting the relative position of the eccentric tube with respect tot he eccentric shaft to adjust the clearance between the master cylinder and the blanket cylinder.

8. An offset printing machine as in claim 7 further including:

a device for arresting movement of the lever at its second position such that the blanket cylinder, engaging only the master cylinder, will be inked for several revolutions as desired before engaging with the impression cylinder; and release means coupled to the arresting device to selectively enable release of the arresting device and allow the blanket cylinder to continue movement to the impression cylinder.

9. An offset printing machine as in claim 8 further including:

a solenoid attached to a frame wall as the release means;

a latch pivotally coupled to the solenoid and operable between first and second positions; and a roller on the latch such that when the latch is in the second position the lever arm can move freely form the third position to the first position, but as a result of the operation of said device for arresting movement, the lever can move from the first position only to the second position to cause the blanket cylinder to be inked for several revolutions.

10. An offset printing machine as in claim 9 wherein the lever arm has a square corner on the end on one side and an arcuate corner on the end on the other side such that when the lever arm moves toward the first position from the third position, the rounded edge contacts the roller, pivots the latch arm down and allows the lever arm to pass by the roller and such that when the lever arm moves from the first position toward the third position, the square corner contacts the roller and holds the lever arm in the second position until the solenoid is activated to pivot the latch to its second position thereby moving the roller and allowing the lever arm to continue on toward the third position.

11. An offset printing machine as in claim 1 further comprising:

a second fixed master cylinder rotatably mounted between the walls on the opposite side of the fixed impression cylinder for carrying a transferable image thereon;

a second blanket cylinder on the opposite side of the impression cylinder and rotatably mounted on an additional eccentric shaft for rotation about an axis spaced from and parallel to the axis of the additional eccentric shaft; and a second lever for rotating the additional eccentric shaft to first, second and third positions to cause the second blanket cylinder axis to move along an arc from a corresponding first position that separates the second blanket cylinder from both the second master cylinder and the impression cylinder to a corresponding second position that engages the second blanket cylinder with the second master cylinder for inking and to a corresponding third position that engages the second blanket cylinder with both the second master cylinder and the impression cylinder for transferring the image on the master cylinder to the paper on the impression cylinder.

12. An offset printing machine comprising:

laterally spaced frame side walls;

a fixed master cylinder rotatably mounted between the walls for carrying a transferable image thereon;

a fixed impression cylinder rotatably mounted between the walls for carrying paper thereon to receive the image;

a blanket cylinder mounted on an eccentric shaft between the walls for eccentric rotation about an axis, said blanket cylinder having a blanket mounted thereon, said blanket having a predetermined thickness;

a plate rigidly coupled to the eccentric shaft;

a lever pivotally attached at one end to frame side wall for pivotal movement to first, second and third positions about an axis at said one end thereof;

a link coupling the lever to the plate such that pivotal movement of the lever about its axis to the first, second and third positions correspondingly rotates the first eccentric shaft to move the blanket cylinder;

a single piston coupled to the lever at the other end for moving the lever to said first, second and third position and causing the first eccentric axis of the blanket cylinder to move through an arc from a first position that separates the blanket cylinder from both the master cylinder and the impression cylinder to a second position that engages the blanket cylinder with the master cylinder for transferring said transferable image from said master cylinder to said blanket cylinder and to a third position that engages the blanket cylinder with both the master cylinder and the impression cylinder for transferring the image on the blanket cylinder to the paper on the impression cylinder; and an operator adjustable eccentric element mounted in the frame wall for receiving said one end of the lever such that, by rotating the eccentric element predetermined distances, the coupling link is moved to cause the blanket cylinder first eccentric shaft to be rotated distances sufficient to adjust the blanket cylinder/impression cylinder relative movement for variation in blanket thickness.

13. An offset printing machine as in claim 12 further comprising:

a second fixed master cylinder rotatably mounted between the frame walls on a side of the impression cylinder opposite the first master cylinder;

a second blanket cylinder eccentrically mounted between the frame walls for rotation on a side opposite the other eccentrically mounted blanket cylinder; and a second single piston coupled to the second eccentrically mounted blanket cylinder to cause the second blanket cylinder axis to move along an arc from a first position that separates the second blanket cylinder from both the second master cylinder and the impression cylinder to a second position that engages the second blanket cylinder with the second master cylinder for inking and to a third position that engages the second blanket cylinder with both the second master cylinder and the impression cylinder for transferring the image on the second master cylinder to the paper on the impression cylinder thus forming a two-color offset printing machine.

* * * * *

UNITED STATES PATENT AND TRADEMARK OFFICE

CERTIFICATE OF CORRECTION

PATENT NO. : 5,265,529

DATED : November 30, 1993

INVENTOR(S) : Leonard I. Tafel

It is certified that error appears in the above-indentified patent and that said Letters Patent is hereby corrected as shown below:

Column 5, line 44, after "or" insert
--disc 54--.

Column 9, line 4, change "15" to
--151--.

Column 10, line 47 in Claim 1, change "form" to
--from--.

Column 10, line 65 in Claim 1, change "form" to
--from--.

Column 11, line 68 in Claim 7, change "tot he" to
--to the--.

Column 12, line 21 in Claim 9, change "form" to
--from--.

Signed and Sealed this

Thirteenth Day of December, 1994

Bruce Lehman

*Attest:*

BRUCE LEHMAN

*Attesting Officer*

*Commissioner of Patents and Trademarks*